United States Patent [19]

Menegatto

[11] Patent Number: 4,731,985

[45] Date of Patent: Mar. 22, 1988

[54] SPINDLE SUPPORTING DEVICE

[76] Inventor: Carlo Menegatto, Via E. Spreafico No. 3, 20052 Monza, Milano, Italy

[21] Appl. No.: 817,532

[22] Filed: Jan. 9, 1986

[30] Foreign Application Priority Data

Jun. 11, 1985 [IT] Italy ..... 21100 A/85

[51] Int. Cl.[4] ..... D01H 7/12; F16C 35/08; F16F 15/00

[52] U.S. Cl. ..... 57/135; 57/130; 248/560; 248/603; 248/606; 384/227; 384/228; 384/230; 384/239

[58] Field of Search ..... 384/226–236, 384/239; 57/130–135, 129; 248/560, 562, 565, 571, 575, 576, 580, 603, 605, 606

[56] References Cited

U.S. PATENT DOCUMENTS

| | | | |
|---|---|---|---|
| 2,433,987 | 1/1948 | Gleitz et al. | 57/89 |
| 2,648,948 | 8/1953 | Soussloff et al. | 57/89 |
| 2,811,824 | 11/1957 | Sweet | 57/135 X |
| 2,863,278 | 12/1958 | Scragg | 57/135 |
| 3,049,860 | 8/1962 | Beerli | 57/135 |
| 3,100,960 | 8/1963 | Pavlovich, Jr. | 57/130 |
| 3,251,180 | 5/1966 | Klein | 57/89 |
| 3,640,057 | 2/1972 | Branson | 57/130 X |
| 3,798,888 | 3/1974 | Mandl | 57/135 |
| 3,874,751 | 4/1975 | Okubo et al. | 57/129 X |
| 3,927,515 | 12/1975 | Northup et al. | 57/89 X |
| 4,045,948 | 9/1977 | Hannibal | 57/135 X |
| 4,254,614 | 3/1981 | Miyamoto et al. | 57/130 X |
| 4,257,220 | 3/1981 | Menegatto | 57/89 |
| 4,299,085 | 11/1981 | Olowinski et al. | 57/135 X |
| 4,348,860 | 9/1982 | Hartmannsgruber | 57/129 X |

FOREIGN PATENT DOCUMENTS

| | | |
|---|---|---|
| 550108 | 5/1932 | Fed. Rep. of Germany . |

*Primary Examiner*—John Petrakes

*Attorney, Agent, or Firm*—Cushman, Darby & Cushman

[57] ABSTRACT

A device for supporting the spindles of textile machines, in which a spindle support cartridge is radially held by means of a double system of elastically-yielding thrust members, disposed inside an outer casing for the cartridge, and radially acting on the cartridge itself.

17 Claims, 5 Drawing Figures

SPINDLE SUPPORTING DEVICE

BACKGROUND OF THE INVENTION

This invention refers to a support for spindles of textile machines, by means of which a spindle is removably supported in order to dampen the vibrations or shocks to which it is subjected when it is made to rotate at a very high speed.

There are currently numerous known systems for supporting spindles, which have a complex structure; for this reason replacing a spindle proves to be a complicated operation which requires a considerable amount of time due to the need to disassemble and remove the entire supporting device. Consequently, whenever the spindles on a machine require replacing, the machine must be put out of service for considerable periods of time, thus reducing the production.

Moreover, due to the high speeds of rotation of the spindles on modern machines, which are constantly increasing, and which can reach or even exceed 20,000/30,000 revolutions a minute, the support cartridge and the lower end of the spindle are subject to considerable overheating and therefore call for the use of complex cooling systems.

A scope of this invention is to provide an extremely efficient spindle supporting device capable, that is, of damping to the highest degree, the vibrations caused by any possible disalignment of the spindle or by out of balance of the spool. The device is also extremely simple in structure and enables the spindle to be quickly removed and replaced without having to disassemble or remove the entire supporting device.

A further scope of this invention is to provide a spool supporting device, as described, in which the cartridge containing the bearings for the spool can be efficiently air-cooled, thereby avoiding the use of complicated lubricating and cooling systems, which are not always reliable.

BRIEF DESCRIPTION OF THE DRAWINGS

These and further scopes can be achieved with a spool supporting device, as described hereunder with reference to the examples of the accompanying drawings, in which.

DESCRIPTION OF THE INVENTION

Figure 1:
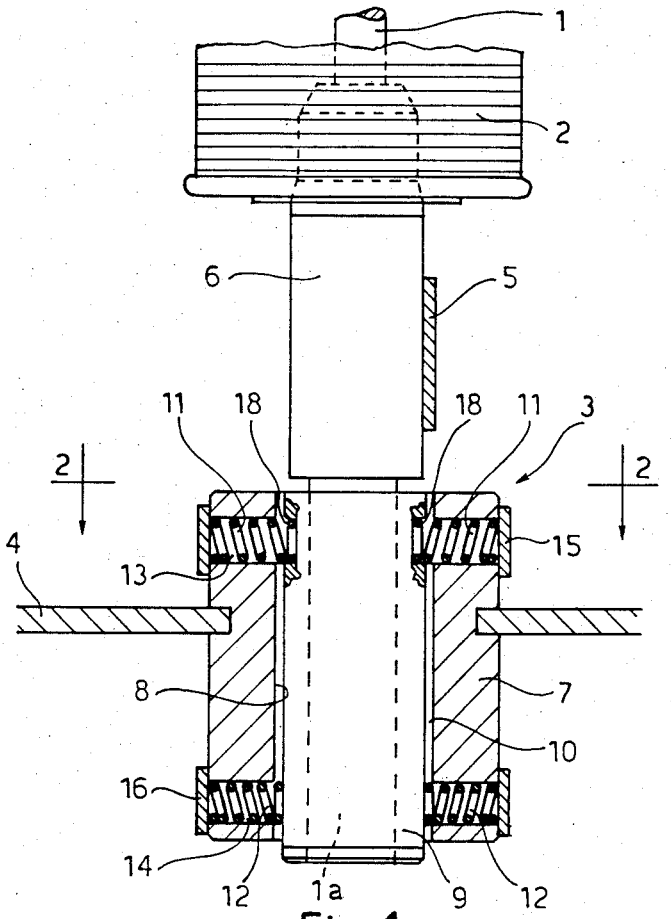
FIG. 1 shows a cross-sectional view of a spool supporting device.
Figure 2:
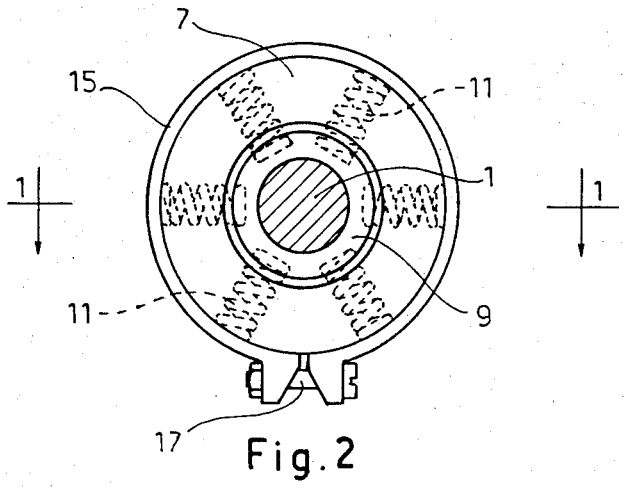
FIG. 2 shows a cross-section along the line 2—2 of FIG. 1.

FIGS. 1 and 2 show a first embodiment of the spool supporting device according to this invention. In said figures, reference 1 indicates a textile spindle for supporting a spool of yarn 2, partially shown, said spindle being supported for rotation on a supporting device generally indicated by reference 3, which is secured to the frame 4 of a textile machine.

The spindle 1 is usually made to rotate at high speed by means of a tangential belt 5 in contact with the belt-pulley 6 of the spindle.

In addition to allowing the rotation of the spindle, the supporting device 3 must also be able to dampen all the vibrations or shocks to which the spindle 1 is subject during rotation. Furthermore, as mentioned previously, it must allow the spindle to be quickly and easily removed and replaced but at the same time be simple and sturdy in structure. According to this invention, the device 3 comprises a cylindrical body 7 or casing, secured in any suitable way to the frame 4 of the machine, which is provided with a central hole 8 for housing a cartridge 9 containing the bearings for rotation of the spindle, not shown, through which the lower end 1*a* of the spindle extends in a per se known manner. The hole 8 in the supporting body, is greater in diameter than the external diameter of the cartridge 9 so as to form an open-end annular space 10 therebetween, surrounding the entire cartridge 9 which is thus constantly cooled.

The cartridge 9 and, therefore, the spindle 1, are supported by means of a double system of elastically yielding thrust members, each one comprising in this case, a plurality of radially arranged spring members 11, 12 disposed peripherally and close to the ends of the cartridge 9; the spring members 11, 12 in each group, exert a radial thrust and are pressed with the necessary force, against the outer surface of the spindle cartridge 9; consequently, in order to keep the spindle 1 in a stable vertical position, the spring members 11, 12 in each group, lying on the same plane, are angularly and evenly spaced apart from one another, and should preferably be provided in diametrically-opposed pairs.

The thrust members may however be shaped in any way, for example, in the case of FIG. 1, they have been shown in the form of helical springs; it is clear, however, that blocks or pads of elastomeric material, such as natural or synthetic rubber or other suitable plastic material may be used in place of the springs 11, 12.

In the case of FIG. 1, six springs 11, 12 in opposing pairs have been used for each group; it is clear however that any other number of spring members, and any other radial disposition may be used, with the spring members in each group disposed with their longitudinal axes orientated radially on the same plane, at right angles to the axis of the spindle 1. Each spring member 11, 12 moreover is housed in an appropriate seat in the cylindrical casing 7; each seat consists of a radial hole 13, 14 which opens both towards the inside and towards the outside of the casing 7. Consequently, each spring member 11, 12 rests on one side against the cartridge 9 and one the other side, the outer one, it rests against a removable retaining element, for example, a split ring 15, 16 which can be tightened against the casing 7, or loosened, by means of a screw 17 or other fastening means.

From this example, it is clear that the spindle 1 is held in an upright position and that its vibrations are efficiently damped by the double set of radial supporting spring members; moreover, the weight of the spindle and of the spool are prevalently discharged on the first upper set of spring members, for example, so that each spring member 11 extends into a seat 18 in the cartridge body 9, thus defining a sort of movable fulcrum which is elastically kept in a central position in the hole 8 by the action of the opposing springs 11. The springs 12, positioned below, serve to dampen the vibrations and to keep the spindle upright by opposing its tendency to drop under its own weight and that of the supported spool.

The device according to this invention proves to be advantageous for the following reasons: the entire spindle 1, with the cartridge 9, can be easily removed and replaced by simply loosening the screws 17 and removing the two rings 15 and 16, thus supressing the radial thrust of the spring members 11, 12 and enabling the spindle to be removed by simply sliding the cartridge out of the cylindrical hole 8. Moreover, it is possible to replace the spindle with another one without having to keep close tolerances for the internal diameter of the hole 8 in the supporting casing and the external diameter of the cartridge 8, due to the fact that any slight differences are automatically compensated by the supporting springs and by the annular space 10.

A further advantage of the supporting device according to this invention consists in the possibility of replacing the springs of one type, of one or both of the two sets, with springs of another type, capable of withstanding heavier loads, if necessary, by simply loosening and shifting the rings 15, 16, removing the existing spring members, replacing them with other ones, and repositioning the stop rings, retightening their screws 17.

It will be clear from the foregoing description and the accompanying drawings, that the invention refers to a new type of flexible support for the spindles of textile machines and the like, in which the use of sets of springs or resilient pads radially yielding, disposed on different planes, permits the quick and easy removal and/or replacement both of the spindle and of the thrust members, in order to fulfil and/or adapt to any requirement whatsoever of the user, without long and complicated operations, and at a relatively low cost. Moreover, due to the disposition of the cartridge 9 containing the bearings for rotation of the spindle, inside a through hole 8 in the cylindrical casing 7, the cartridge and the bearings contained therein can be very effectively air-cooled, thus preventing transmission of the heat to other parts of the machine or to the spool of yarn which, in the case of yarns of thermoplastic materials, could suffer damage.

Figure 3:
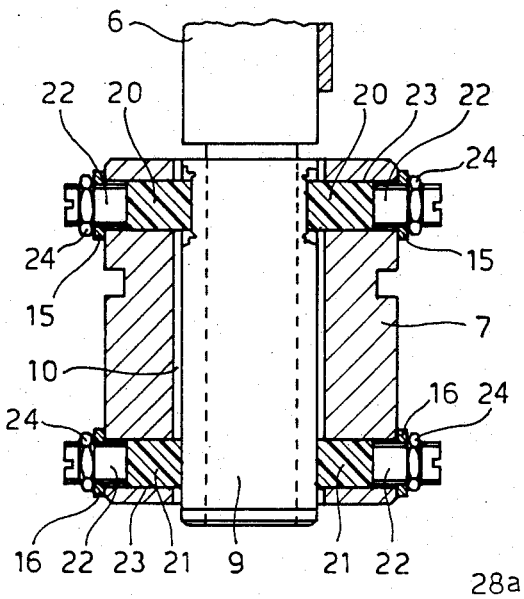
FIG. 3 shows a cross-section similar to that of FIG. 1, for a second embodiment.

FIG. 3 of the drawings shows a second embodiment similar to the previous one, in which cylindrical-shaped resilient pads 20, 21, also disposed with their longitudinal axes in radial bores 23 in the supporting casing 7, have been used in place of the springs 13 and 14 of the two sets of spring members of FIG. 1. The device of FIG. 3 further differs from that of the previous figures due to the fact that it is provided with means for adjusting the thrust exerted by the thrust members 20, 21 against the spindle cartridge 9. The possibility of adjusting the thrust of each thrust member 20, 21 on the cartridge 9, and of substantially graduating it, is advantageous for two reasons: first, that the spindle can be kept correctly balanced, precisely by individually adjusting the thrusts of the two sets of thrust members; secondly, that one spindle can be replaced with another one, or be adapted to support spools of different weights, by suitably adjusting the radial thrusts on the supporting cartridge.

In the embodiment shown in FIG. 3, adjustment of the thrust exerted by the thrust members 20, 21 on the cartridge 9 is achieved by adjustable back-thrust means comprising threaded pins 22 which screw into a corresponding threaded hole in each external ring 15, 16 penetrating into the same seat or radial hole 23 housing the thrust member 20, 21. The threaded pins 22 are secured in the adjusted position, for example, by means of a lock nut 24 or in any other suitable way. It is obvious that by loosening the nut 24 and turning the threaded pin 22 by means of a normal screwdriver, it is possible to vary the pressure exerted on the cartridge by the supporting thrust members 20, 21, by adjusting it to the desired value.

Figure 4:
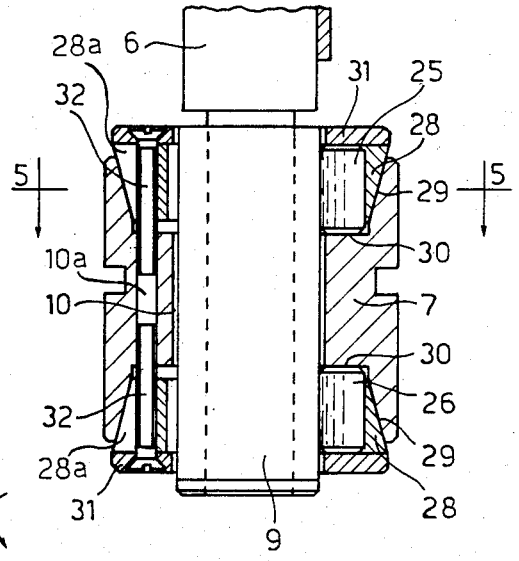
FIG. 4 shows a view similar to that of FIG. 1, for a third embodiment.
Figure 5:
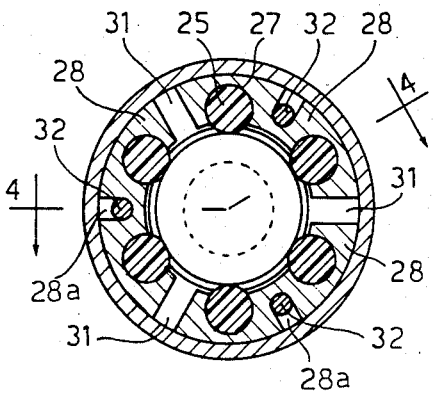
FIG. 5 shows a cross-section along the line 5—5 of FIG. 4.

FIGS. 4 and 5 of the drawings show a third embodiment which comprises a peripheral disposition of the resilient pads; as shown, in this case use is made of resilient pads 25, 26 disposed lengthwise or with their axes lying parallel to the axis of the spindle supporting cartridge 9. The pads 25 and 26 in each set, are arranged in corresponding cylindrical seats 27 which open towards the internal cylindrical surface of conical housing sectors 28, three in this case; the conical sectors 28 are arranged around the cartridge 9, in corresponding conical seats 29 at each end of the supporting casing 7. The cylindrical pads 25 and 26 protrude from the conical sectors 28 and are greater in length than the conical sectors 28, so as to rest against annular shoulders 30 inside the seats 29.

Consequently, by axially pressing upon the cylindrical pads 25, 26, for example, by means of cover members 31 and screws 32 passing through longitudinal slots **28*a* in the sectors 23, 29 and screwed into threaded holes 10*a* in the casing 7, a double action is exerted on the cylindrical pads supporting the cartridge 9, and precisely, a first axial compression which tends to radially swell the pads which are counteracted by the external conical sectors and transform their axial compression into a radial thrust against the cartridge 9, and a second radial compression caused by the conical sectors 28 sliding along the conical surfaces of their seat 29; in this connection, in order to also permit an adequate grading and adjustment of the pressure exerted by the pads 25, 26 against the cartridge 9, the sectors 28 corresponding to each set of resilient pads, are spaced apart from one another circumferentially, as indicated by the gaps 31, so as to allow them to approach one another and to slide along the conical surfaces of the aforesaid seat. In this case, use has been made of three independent sectors 28, however it is clear that the number of sectors, for each set of pads, may be varied, or that a conical split ring may be used in place of the pads, whilst maintaining, in all cases, the possibility both of adjusting the thrust of the pads by means of radial and axial compression of the same in order to grade the pressure of the resilient pads against the cartridge 9 by varying, for example, the clamping force of the screws 32**, and also the possibility of quick and easy removal and/or replacement of the spindle, as in the previously illustrated cases. Modifications and variations may therefore be made without thereby deviating from the inventive principles described and claimed herein.

What is claimed is:

1. A spindle supporting device, in which a spindle is supported for rotation by means of bearings housed in a cylindrical spindle cartridge having an outer diameter, said device comprising an external support casing provided with means defining an open central hole open to both ends for housing said cartridge, said central hole means having an inner diameter greater than the outer diameter of the spindle cartridge thereby defining an annular air-gap therebetween; a first and a second set of independent elastically yielding thrust members disposed peripherally between said support casing and the cylindrical spindle cartridge, and retaining means for urging said thrust members radially towards and against the cylindrical spindle cartridge.

2. A device as claimed in claim 1, in which said thrust members consist of cylindrical pads made of elastomeric material.

3. A device as claimed in claim 1, in which said thrust members consist of helical springs.

4. A device as claimed in claim 1, in which said thrust members are seated in radial through holes in the external casing, said holes in each set having their longitudinal axis angularly spaced apart and lying in a plane at right angles to the axis of the spindle.

5. A device as claimed in claim 4, in which at least some of the thrust members penetrate into corresponding seats provided in the cartridge of the spindle.

6. A device as claimed in claim 4, in which the retaining means are in the form of removable split rings disposed on the outside of the casing around the holes for the thrust members, and means for tightening said split rings.

7. A device as claimed in claim 1, comprising adjusting means to vary the radial thrust exerted by each thrust member against the spindle cartridge.

8. A device as claimed in claim 7, in which said thrust members are disposed in radial holes of the external casing, said thrust adjusting means comprising sliding pins in the radial holes, and screw means for retaining the thrust pins in any desired adjusting position.

9. A device as claimed in claim 8, comprising removable split rings to retain said thrust members, said pins comprising a screw portion threaded in holes provided in the removable split rings.

10. A device as claimed in claim 1, in which said thrust members consist of cylindrical resilient pads disposed with their longitudinal axis parallel to the axis of the spindle.

11. A device as claimed in claim 10, and means for adjusting the radial thrust against the spindle supporting cartridge, said adjusting means comprising back-thrust means for axial and radial compression of the resilient pads.

12. A device as claimed in claim 1, in which the means for the compression of the resilient pads comprise a split ring having inner seats for the thrust member and an outer conical surface, and a conical seat for the split ring in said support casing.

13. A device as claimed in claim 11, in which the means for the compression of the resilient pads comprise conical sectors in a conical seat inside the support casing, said resilient pads protruding from respective seats on the inner surface of the conical sectors; an annular shoulder in the conical seat of the support casing; a back-thrust element, acting against the resilient pads and the aforesaid conical sectors, and screw means passing through longitudinal slots in the conical sector and in threaded holes in said support casing.

14. A device as claimed in claim 1, in which the hole in the external casing for the spindle cartridge defines an annular space open at both ends for circulation of cooling air.

15. A device as in claim 1, wherein the first and second sets of elastically yielding thrust members cooperate to radially center and axially support the spindle and cylindrical spindle cartridge.

16. A device as in claim 1, wherein the first and second sets of thrust members are axially spaced apart a distance less than the length of said cylindrical spindle cartridge.

17. A device as in claim 1, wherein said retaining means includes means for adjusting the amount of radial force the first and second sets of thrust members apply against said cylindrical spindle cartridge.

* * * * *